US008628375B2

(12) United States Patent
Jeong

(10) Patent No.: US 8,628,375 B2
(45) Date of Patent: Jan. 14, 2014

(54) MOBILE AVAILABLE FOR UTILIZATION OF BOTH SIDES

(76) Inventor: Young Ho Jeong, Sungnam (KR)

( * ) Notice: Subject to any disclaimer, the term of this patent is extended or adjusted under 35 U.S.C. 154(b) by 352 days.

(21) Appl. No.: 12/747,894

(22) PCT Filed: Nov. 7, 2008

(86) PCT No.: PCT/KR2008/006557

§ 371 (c)(1),
(2), (4) Date: Jun. 11, 2010

(87) PCT Pub. No.: WO2009/075477

PCT Pub. Date: Jun. 18, 2009

(65) Prior Publication Data

US 2010/0267310 A1 Oct. 21, 2010

(30) Foreign Application Priority Data

Dec. 11, 2007 (KR) ..... 10-2007-0128561

(51) Int. Cl.
*A63H 33/00* (2006.01)

(52) U.S. Cl.
USPC ..... 446/227; 446/242; 446/248

(58) Field of Classification Search
USPC ..... 446/81, 118, 119, 227, 318, 242, 248
See application file for complete search history.

(56) References Cited

U.S. PATENT DOCUMENTS

| | | | | |
|---|---|---|---|---|
| 6,447,362 | B2 | 9/2002 | Khamphilavong et al. | |
| 6,475,057 | B1 | 11/2002 | Norman | |
| 7,762,865 | B2 * | 7/2010 | Gelfond et al. | 446/227 |
| 2001/0055931 | A1 | 12/2001 | Khamphilavong et al. | |
| 2002/0094748 | A1 * | 7/2002 | Baik | 446/227 |
| 2003/0153240 | A1 * | 8/2003 | DeJule | 446/227 |
| 2005/0287909 | A1 * | 12/2005 | Gelfond | 446/227 |

FOREIGN PATENT DOCUMENTS

| | | |
|---|---|---|
| CN | 101001757 | 7/2007 |
| KR | 20-0180295 | 2/2000 |
| KR | 30-0293327 | 2/2002 |

OTHER PUBLICATIONS

International Search Report for PCT/KR2008/006557 mailed Jun. 11, 2009.

* cited by examiner

*Primary Examiner* — Nini Legesse

(57) ABSTRACT

The present invention relates to a mobile for an infant, and more particular, to a mobile available of both sides, comprising a mobile body including a lower face formed as a black and white face (11) and an upper face formed as a color face (12); rings (20, 20') formed, respectively, on the centers of the black and white face (11) and the color face (12); and a rim (30) formed suturingly on an outer peripheral surface of the mobile body (10).

21 Claims, 14 Drawing Sheets

MOBILE AVAILABLE FOR UTILIZATION OF BOTH SIDES

RELATED APPLICATIONS

This application is a 371 application of International Application No. PCT/KR2008/006557, filed Nov. 7, 2008, which in turn claims priority from Korean Patent Application No. 10-2007-0128561, filed Dec. 11, 2007, both of which are incorporated herein by reference in their entireties.

TECHNICAL FIELD

The present invention relates to a mobile for a infant, more specifically, to a mobile available for utilization of both sides thereof, comprising: a body 10 a lower face of which makes up a black and white face 11 and an upper face of which makes up a color face 12; rings 20, 20' formed on the black and white face 11 and the color face 12 of the body 10, respectively; and a rim 30 formed suturingly on an outer peripheral surface of the body 10.

BACKGROUND ART

Generally, a mobile may stimulate an infant's sight and helps its brain development. The eyes of the infant are moved along forms and movement of the mobile to stimulate efficiently eyesight of the infant, and it causes to stimulate properly a brain connected to an optic nerve and then it can help an infant brain development which is under a vigorous growth.

Additionally, a symmetric and stable mobile is helpful to a balance feeling of an infant, that is, when the infant sees a moving or rotating mobile, it can develop the balance feeling, and since the forms and shapes seen by the infant are continuously changed, discrimination power can be improved. Meanwhile, when the infant sees the mobile which is hung on a space and occupies a predetermined space, a space feeling can be improved.

Recently, for the aforementioned reasons, a mobile has been essential toy to help a development of an intelligence ability of an infant and further the mobile has to be replaced with another mobile depending on a rapid growth of the infant to stimulate properly a sight feeling of the infant. In particular, in case of an infant being 0-3 months, since a sight is not developed fully, simple stripe shapes having a vivid black and white contrast are good for him/her. In case of the infant being 3-6 months, since he/she starts to sense overall forms of surrounding objects and discriminate partially colors, a mobile of three colors such as red, yellow and blue is goof for him/her. Additionally, in case of an infant being more than 6 months, a plain mobile is not necessary any more, and since he/she can discriminate colors, a three dimensional mobile of original colored animals, airplanes, flowers and cars, etc. has to be provided.

However, since conventional mobiles are provided as a black and white mobile and a color mobile, respectively, a user has to purchase two kinds of mobiles to cost expensively. In particular, in case of the black and white mobile, an utilization period thereof is very short and thus availability is low comparing to its price.

Additionally, when using the color mobile after 3 months, decorative appliances of more various colors and concrete forms have to be provided with the color mobile.

However, blades, rings and decorative appliances of a conventional mobile are fixed integrally, or the rings and the decorative appliances are knotted and tied, or only the decorative appliances are separated. In case of most of conventional mobiles, the decorative appliances are to cut with a scissor or release the knot in order to use them as separate toys and to separate them for a replacement thereof, which causes detachments of the decorative appliances to be difficult.

DISCLOSURE

Technical Problem

Accordingly, the present invention is proposed to solve the above problems of the prior art, and an object of the present invention is to provide a mobile for an infant both sides of which are formed differently in color and/or shapes and thus both sides of the mobile can be utilized economically depending on a growth of the infant without purchasing separate mobiles.

Technical Solution

In order to accomplish the above object, a mobile according to the present invention is anticipated by a concept that a sectional surface is seen to a sight of an infant laying down, wherein the mobile comprises two faces formed differently in color and/or shape, rings formed on the centers of the faces, respectively, and a rim supporting a form of the mobile.

Advantageous Effects

The mobile, which is configured as aforementioned, available of both sides thereof has an effect of forming differently color and/or shape on both faces, thereby providing two types of mobiles.

Additionally, since the mobile is easily detachable using a connection member connected to the ends of the mobile rope which is extended downward from the mobile, and the rings formed on the decorative appliance, the decorative appliance can be replaced conveniently to stimulate properly a sight feeling of an infant depending on a growth of the infant, and is useful for a toy.

Meanwhile, since the mobile rope extended from the mobile is detachable, the color and material of the mobile rope can be replaced easily.

Finally, since the color and/or shape of the respective face of the decorative appliance are formed differently, more than two kinds of decorative appliances seem to be provided.

DESCRIPTION OF DRAWINGS

Further objects and advantages of the invention can be more fully understood from the following detailed description taken in conjunction with the accompanying drawings in which.

BEST MODE

Mode for Invention

The preferred embodiments of a mobile having different colors and/or shapes of two faces, available of both sides according to the present invention will be hereafter described in detail with reference to the accompanying drawings.

The present invention relates to a mobile of different colors and/or shapes of upper face and lower face thereof, available of both sides, and preferably, to a mobile 1 capable of using both sides as a black mobile and a color mobile, comprising a lower face of a black and white face 11 consisting of black and white and an upper face of a color face 12 consisting of colors.

Figure 1:
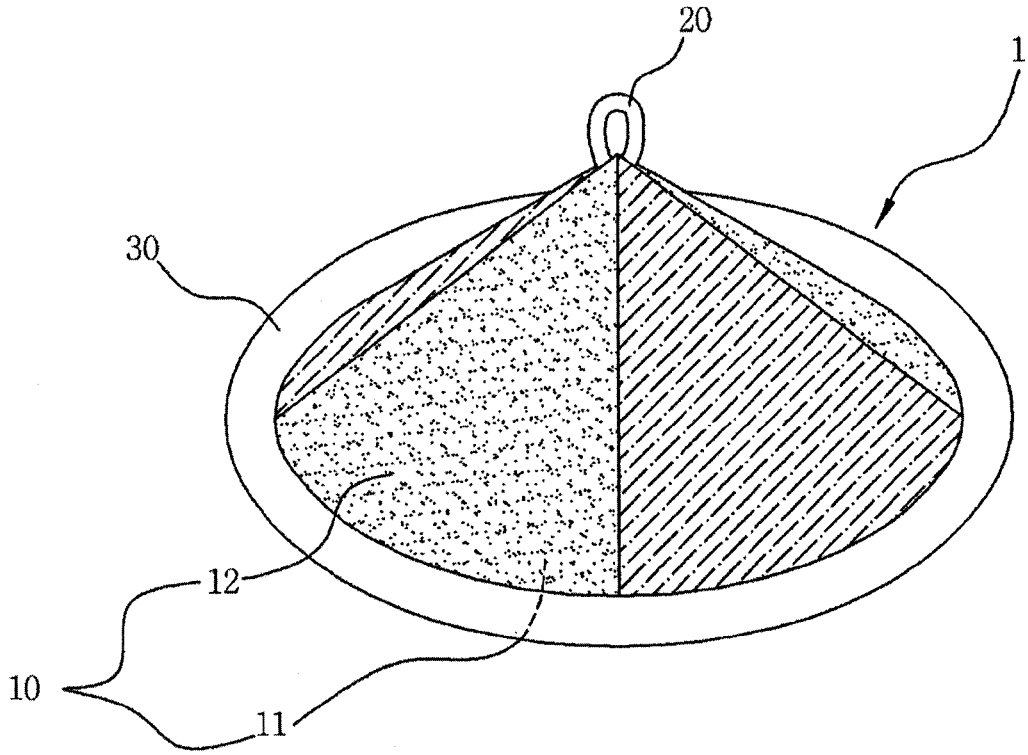
FIG. 1 is a perspective view of an embodiment of a mobile according to the present invention.
Figure 2:
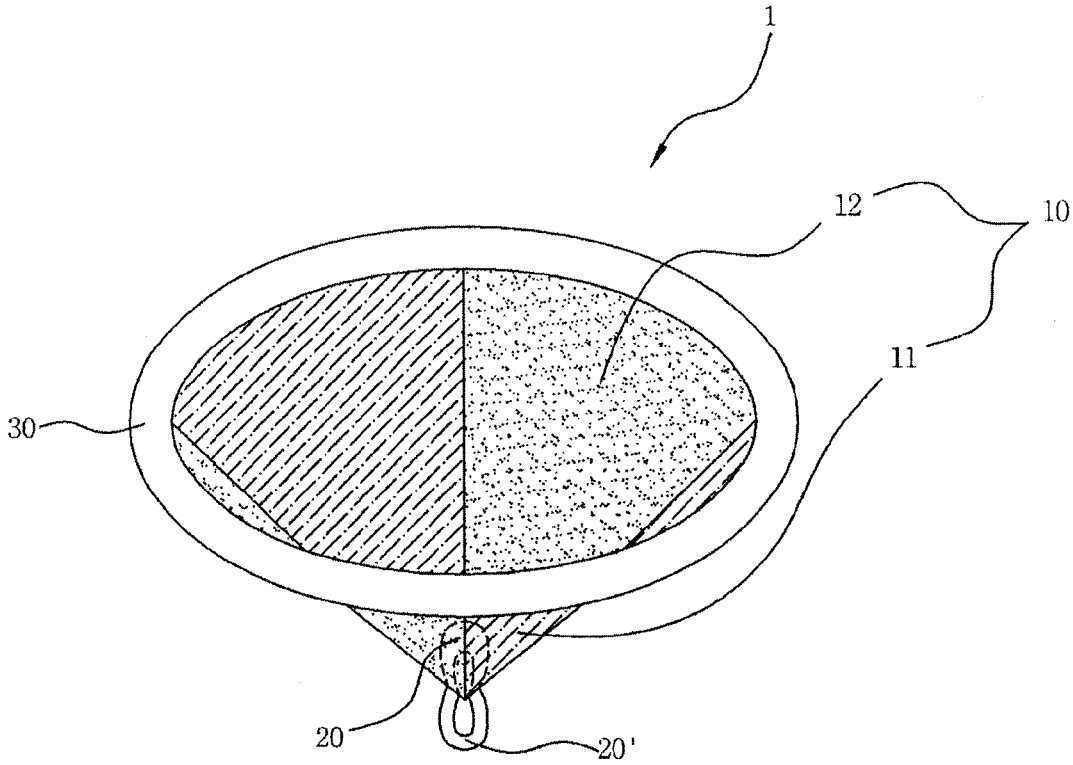
FIG. 2 is a partially exploded view of FIG. 1.

FIGS. 1 and 2 are a perspective view and a partially exploded view of the mobile according to the present invention, respectively. As shown in FIGS. 1 and 2, the mobile for an infant includes the mobile body 10 having a lower face formed as a black and white face 11 consisting of black and white and an upper face formed as a color face 12 consisting of colors, the rings 20, 20' formed on the centers of the black and white face 11 and the color face 12 of the mobile body, respectively, and the rim 30 formed suringly on the outer peripheral surface of the mobile body 10.

The mobile body 10 is unfolded out as a shape of a pyramid such as a cone, a triangular pyramid and a quadrangular pyramid, etc. when the mobile 1 is hung on a ceiling with the rings 20, 20'. Here, the center of the mobile body 10 may be moved up and down around the rim 30 and the color face 12 or the black and white face 11 may be projected. As shown in FIG. 1, the color face 12 is projected upward from the rim 30 and the black and white face 11 becomes an inner surface of the mobile body 10, and the mobile is installed on a ceiling or a mobile hanger using the ring 20 formed on the color face 12. Additionally, decorative appliances later described may be connected to the ring 20' formed on the black and white face 11 of the mobile 1.

FIG. 2 illustrates the mobile where the black and white face 11 is projected downward from the rim 30 and the color face 12 becomes an inner surface of the mobile body 10, and the mobile is installed on a ceiling or bedding using the ring 20' formed on the black and white face 11.

In case of the infants being 0-3 months, since they can not discriminate colors, a black and white mobile formed as black and white showing vivid brightness and darkness is effective to stimulate a sight feeling thereof. For the infants of this age, as shown in FIG. 1, the color face 12 of the mobile is projected and the mobile is installed on a ceiling or a known mobile hanger using the ring 20 formed on the color face 12. As a result, the black and white face 11 formed of black and white is seen to a sight of the infant laying down and thus a black and white mobile is provided.

Additionally, since the infants being more than 3 months can discriminate colors, as shown in FIG. 2, the black and white face 11 is projected and the mobile is installed on a ceiling or a known mobile hanger using the ring 20' formed on the black and white face 11. As a result, the color 12 formed of colors is seen to a sight of the infant laying down and thus a color mobile is provided.

Figure 3:
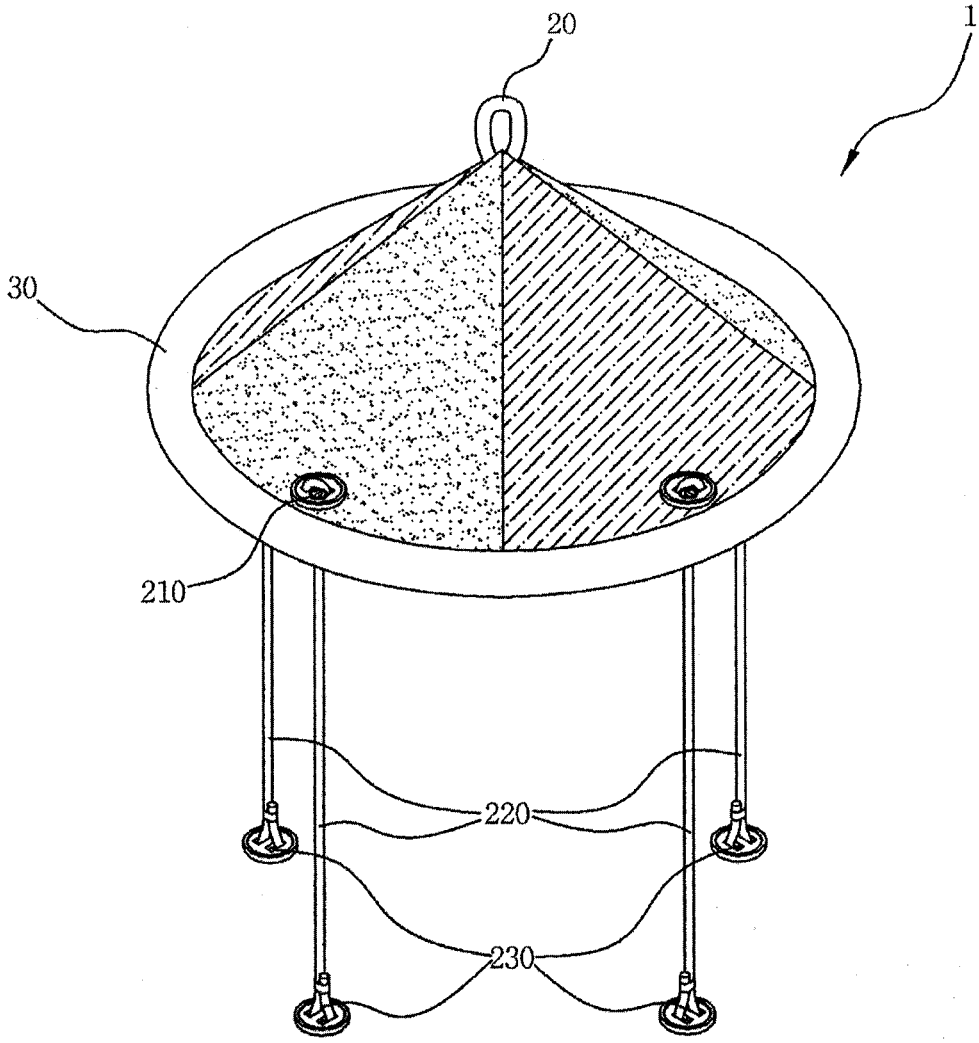
FIG. 3 is a perspective view of another embodiment of a mobile according to the present invention.
Figure 4:
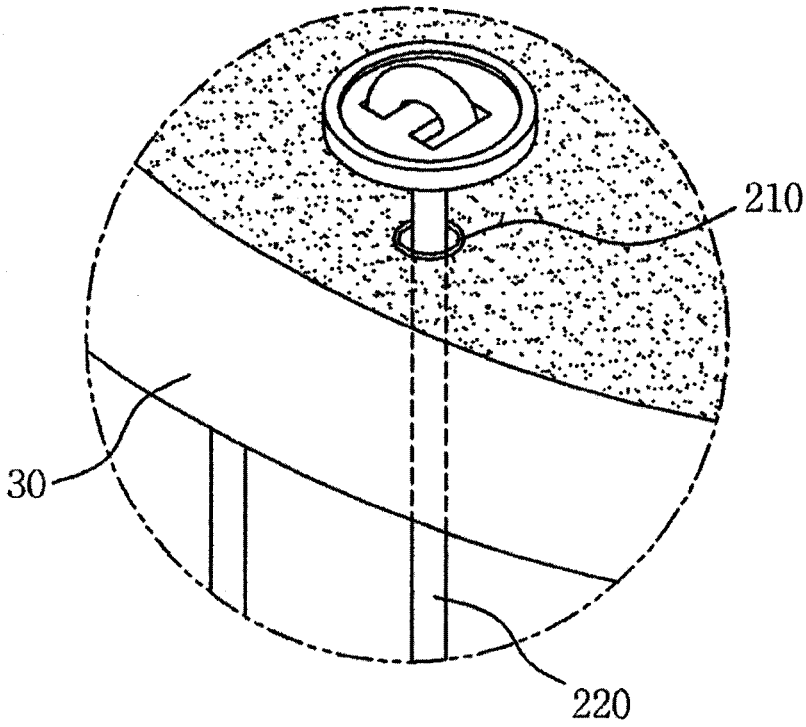
FIG. 4 is a partially exploded view of FIG. 3.
Figure 5:
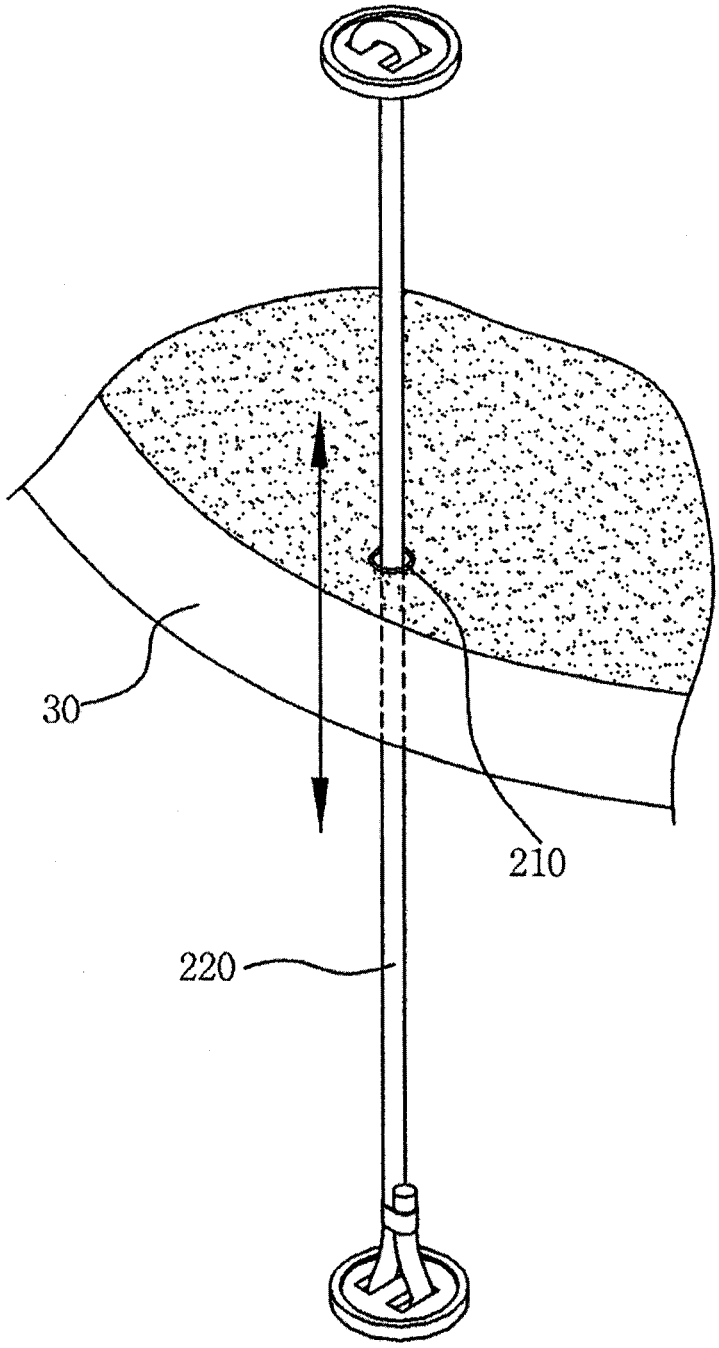
FIG. 5 is a view of a using state of FIG. 3.

FIGS. 3 and 4 are a perspective view and a partial exploded view of an embodiment of the mobile, respectively, according to the present invention wherein a caught support part 210 is formed on an inclined surface of the mobile 1 and the mobile rope 220 passes through the caught support part 210, and a connection member 230 is fastened to both ends of the mobile rope 220. Here, the caught support part 210 is formed in a size for the connection member 230 not to pass through. As shown in FIG. 5, even though the mobile rope 220 is moved up and down, it can not be departed from the mobile body 10 and is spread over the caught support part 210.

Meanwhile, when installing the mobile 1, the rope passes through the mobile body 10 and is extended downward from the mobile body with the connection member 230 of the mobile rope 220 being spread over the caught support part 210. Here, decorative appliances are connected to the connection member 230 fastened to the mobile rope 220.

Figure 6:
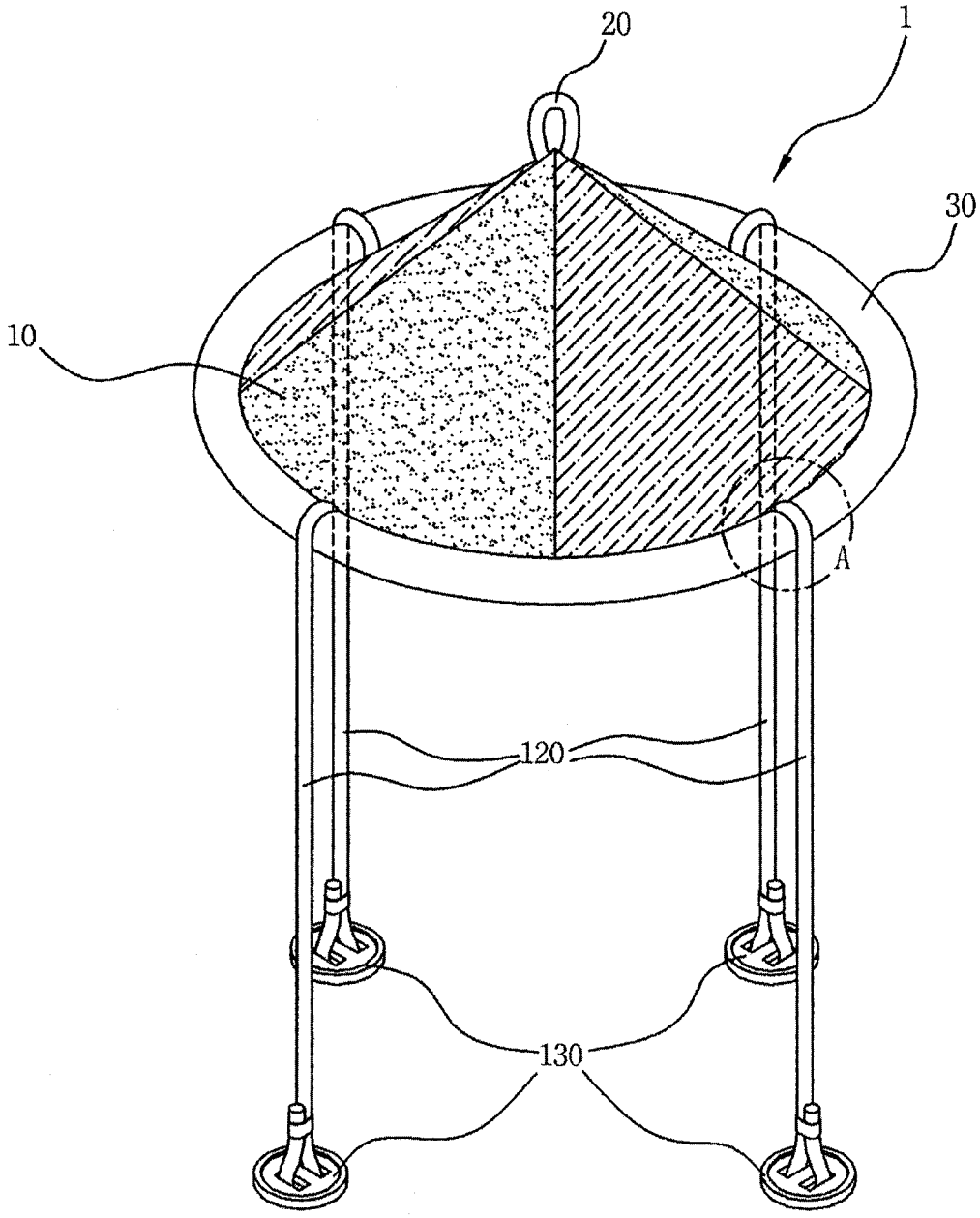
FIG. 6 is a perspective view of still another embodiment of a mobile according to the present invention.
Figure 7:
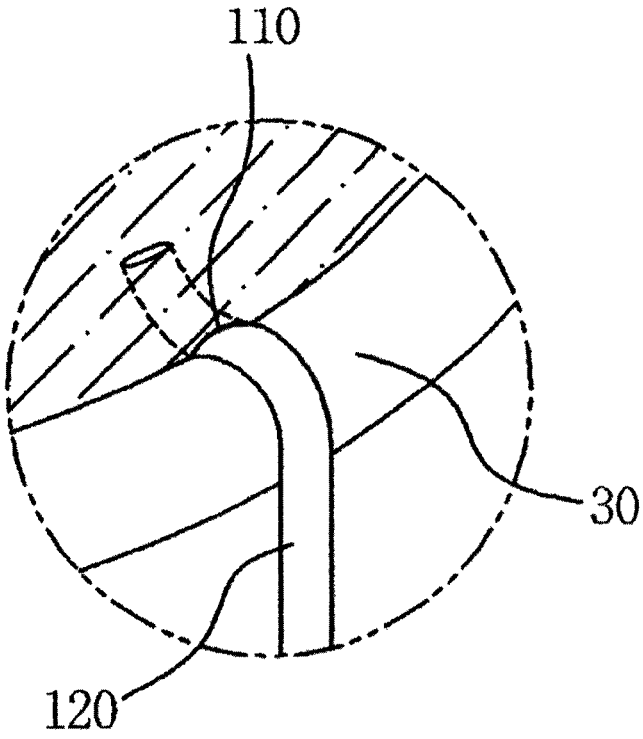
FIG. 7 is a partially exploded view of FIG. 6.

FIGS. 6 and 7 are a perspective view and a partial exploded view of another embodiment of the mobile according to the present invention, respectively wherein the mobile rope 120 is sewn to the mobile 1 to form a fastening part 110 and the mobile is fabricated integrally with the mobile rope 120 extending downward from the fastening part 110. As shown in FIG. 6, when the fastening part 110 is arranged on the upper face of the mobile, the mobile rope 120 is spread over the rim 30 extending downward. Additionally, the connection member 130 to which the decorative appliances are to be attached is connected to the tip end of the mobile rope 120 extended downward, as shown in FIG. 9.

Figure 8:
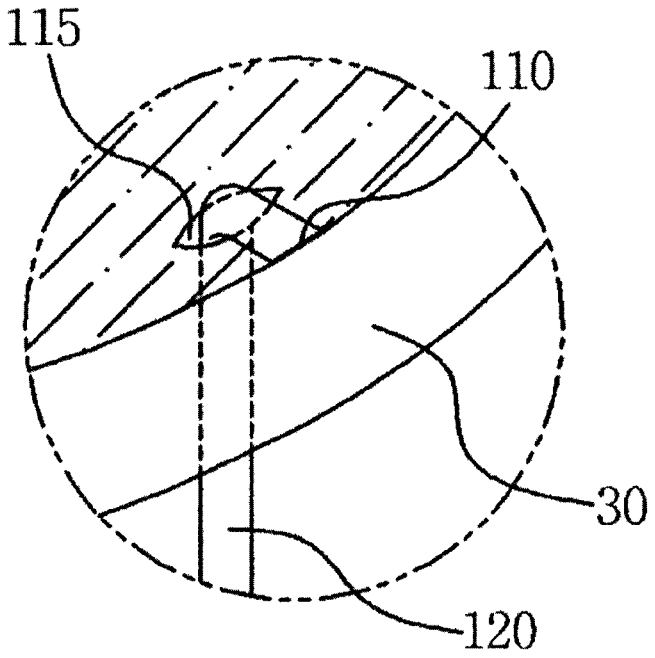
FIG. 8 is a partially exploded view of an alternative embodiment of FIG. 6.

FIG. 8 is a partial exploded view of alternative embodiment shown in FIG. 6, wherein a groove 115 through which the mobile rope 120 to which the connection member 130 is fastened can pass, is formed adjacent to the fastening part 110 and the mobile rope 120 passes through the groove 115 to extend downward. Here, the groove 115 allows the mobile rope 120 to extend downward from the mobile body 10 without being spread over the rim 30 and thus it helps to keep stability of the mobile.

Additionally, the groove 115 formed adjacent to the fastening part 110 of the mobile 1 acts to add the decorative appliances to the mobile 1 such that the connection member 330 connected to the mobile rope 320 is inserted into the groove 115. Preferably, when the fastening part 110 of the mobile rope 120 is formed on the color face 12 and thus the mobile 1 is used as the black and white mobile, the mobile rope extended from the fastening part 110 formed on the upper face thereof is passed through the groove 115 without being spread over the rim to extend from the inner side of the rim to the lower side. When using the mobile as the color mobile, the decorative appliances are added to the groove 115 through the mobile rope 320 as shown in FIG. 12.

Figure 9:
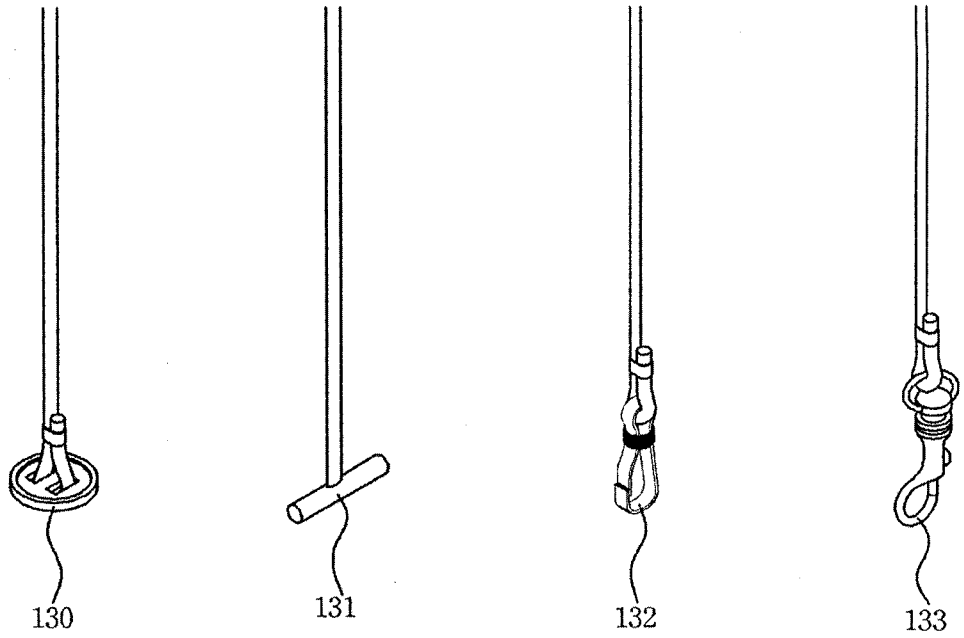
FIG. 9 is a view of a mobile rope applicable to FIG. 6.

FIG. 9 illustrates the kinds of the connection members 130 applicable to the tip end of the mobile rope 120 extending from the mobile 1 wherein a button type 130, a bar type 131, a clip type 132 and a key ring type 133 are shown; however, these types are illustrative.

Figure 10:
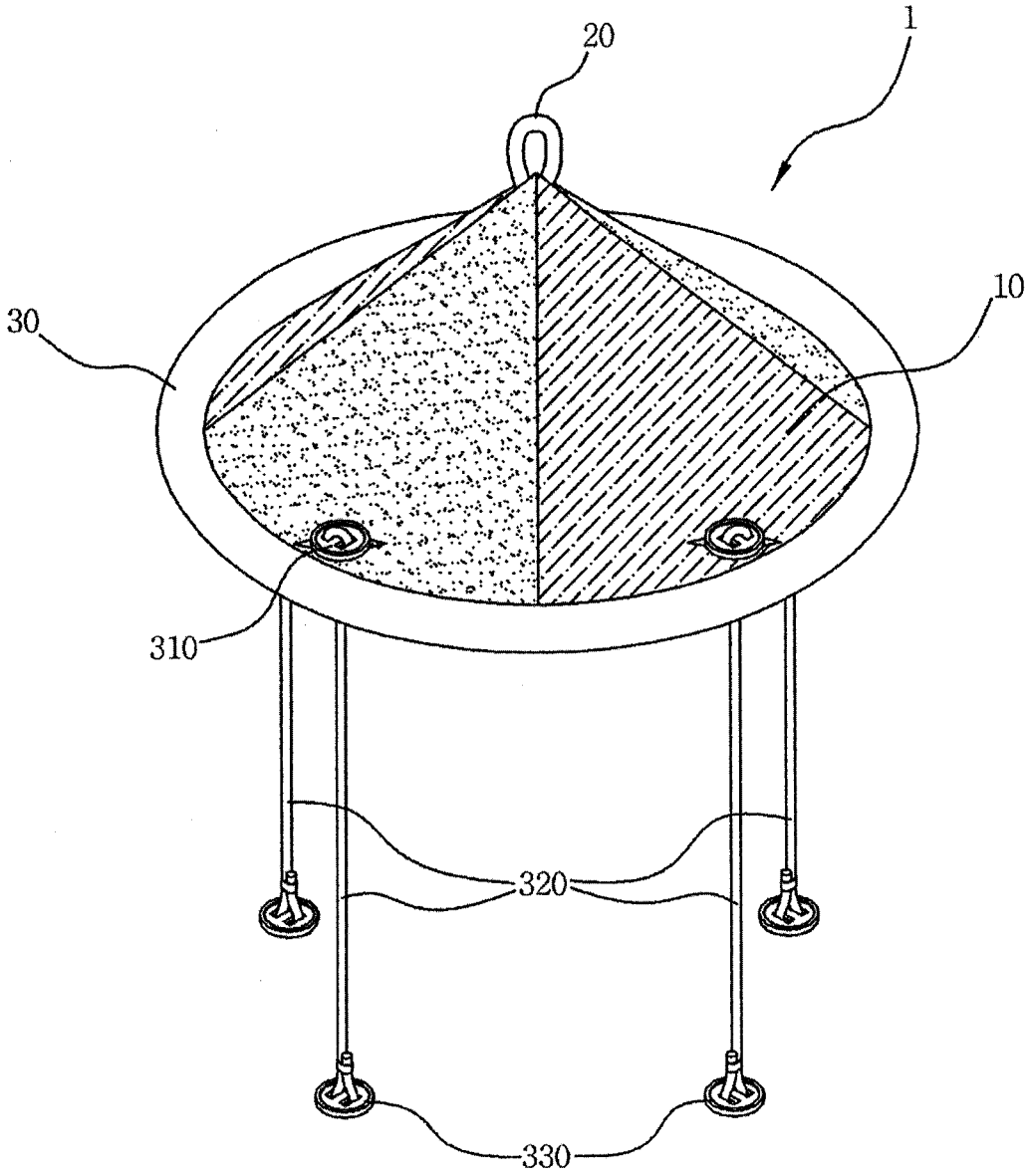
FIG. 10 is a perspective view of still another embodiment of a mobile according to the present invention.
Figure 11:
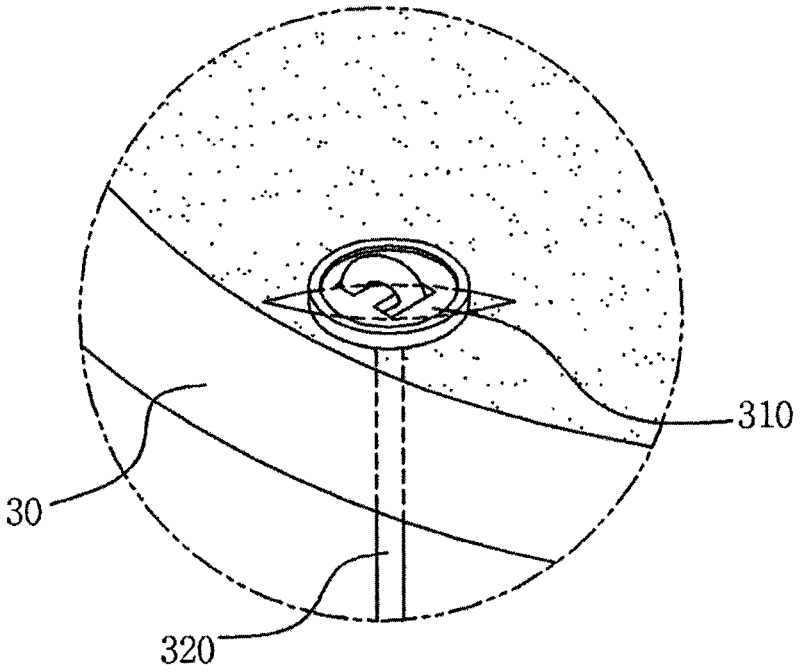
FIG. 11 is a partially exploded view of FIG. 10.
Figure 12:
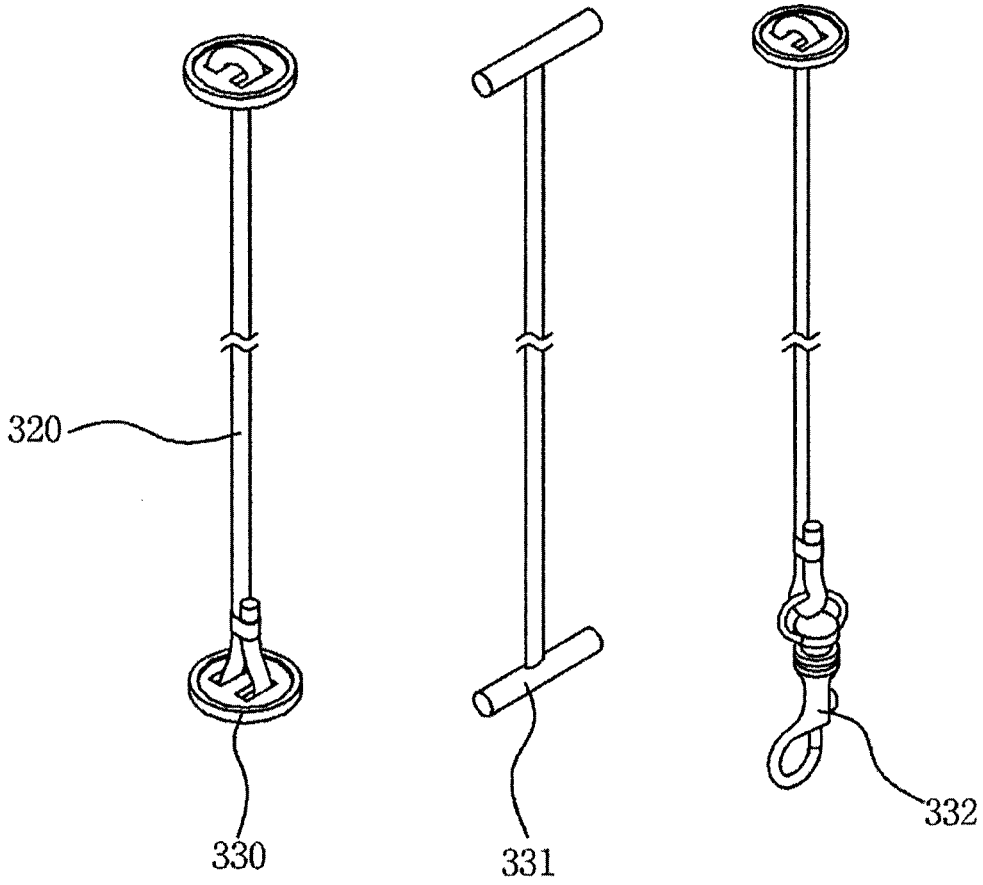
FIG. 12 is a view of a mobile rope applicable to FIG. 10.

FIGS. 10 and 11 are perspective and a partial exploded view of still another embodiment of the mobile according to the present invention, respectively wherein a groove 310 through which the connection member 330 of the mobile rope 320 as shown in FIG. 12 can pass is formed on the inclined surface of the mobile 1 and the mobile rope 320 to both ends of which the connection member 300 is connected is inserted into the groove 310. Here, since the mobile rope 320 can be separated from the mobile body 10, the color and material of the mobile rope can be replaced.

FIG. 12 illustrates forms of the mobile rope applicable to the mobile shown in FIG. 10 wherein an up-down button type 330 and an up-down bar type of up-down same type, and button-key ring type 332 of up-down difference type are shown.

Figure 13:
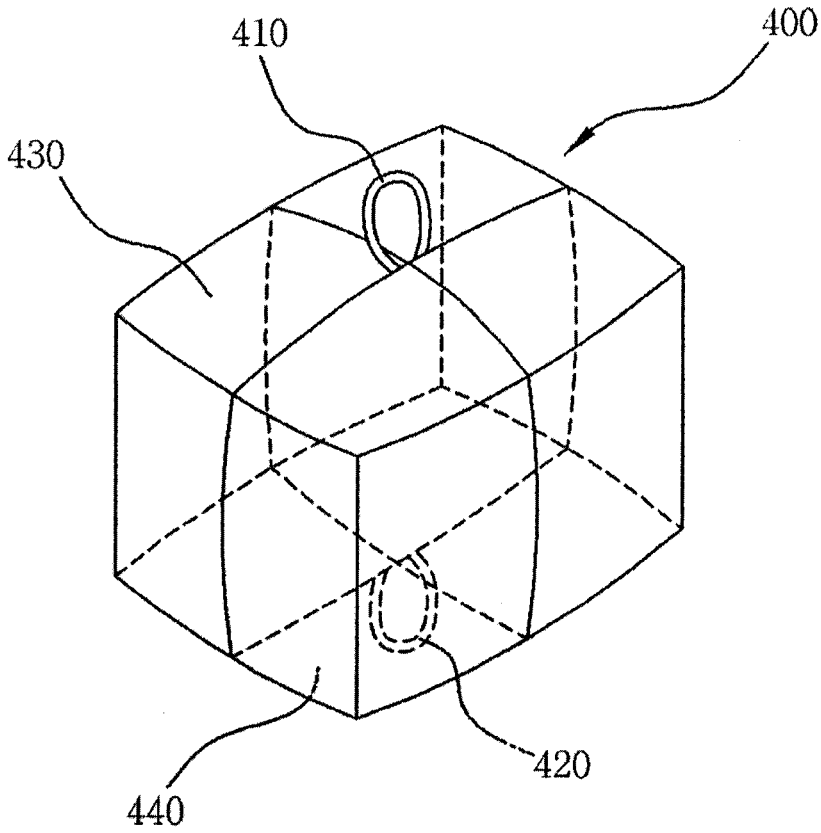
FIG. 13 is a view of a decorative appliance according to the p-present invention.

FIG. 13 illustrates the decorative appliances 400 attachable to the connection member 130 formed on the mobile rope of the mobile as shown in FIGS. 3-12, wherein the decorative appliance 400 forms a black and white face consisting of black and white as a upper face, and forms a color face consisting of colors as a lower face, and ring may be formed on the respective upper face 430 and lower face 440.

Meanwhile, when the black and white face and the color face are formed on the upper face 430 and the lower face 440 of the decorative appliance, respectively, the black and white face, or the color face is seen to the sight of the infant laying down, and thus a black and white mobile, or a color mobile is provided.

In addition, the decorative appliance 400 may formed as a circle shape, a plain type or tetrahedral type, etc, and further the ring is formed on a region corresponding to a center of gravity, thereby providing various faces of the decorative appliance with the infants.

Additionally, it may be configures such that when some sound making units are attached to the internal part or external part of the decorative appliance 400, sound is induced through some stimulation to the mobile to stimulate an auditory feeling of the infant.

Meanwhile, in case of the decorative appliance 400 with the rings 410, 420 formed on the upper face 430 and the lower face 440, respectively, the ring 410 disposed on the upper face 430 of the decorative appliance 400 is connected to the mobile rope extended from the mobile, and a decorative appliance with the connection member 130 is added to the ring 420 disposed on the lower face, or the decorative appliance 400 is added using the mobile rope 320 to both ends of which the connection member 130 is connected as shown in FIG. 12, thereby providing a double mobile or threefold mobile.

Meanwhile, referring to the decorative appliance being spread over the mobile, the decorative appliance where rings are attached on the upper face and the lower face thereof, respectively, and shapes or colors of the upper face and the lower face can be varied, may be applicable to a known mobile blade and a mobile arm, etc. Preferably, the upper face of the decorative appliance is formed as a black and white face, and the lower face thereof is formed as a color face, thereby proving a black and white mobile and a color mobile.

Figure 14:
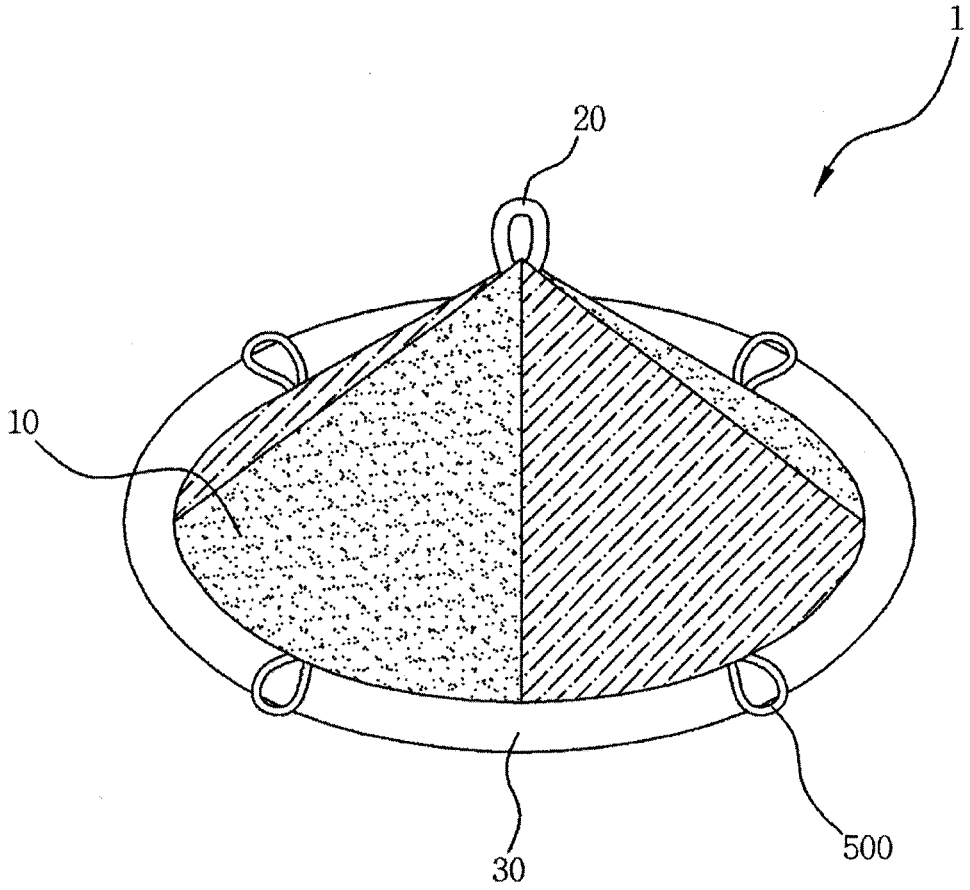
FIG. 14 is a perspective view of still another embodiment of a mobile according to the present invention.

FIG. 14 illustrates rings applicable additionally to the mobile as shown in FIGS. 1 to 12 wherein a ring 500 is formed additionally to the mobile body 10 and the connection member 130 is inserted into the ring 500, thereby providing additionally the decorative appliance.

Although the present invention has been described with reference to several exemplary embodiments, the description is illustrative of the invention and is not to be construed as limiting the invention. Various modifications and variations may occur to those skilled in the art, without departing from the spirit and scope of the invention, as defined by the appended claims.

The invention claimed is:

1. A mobile for an infant, comprising:

a mobile body including a lower face formed as a black and white face with a center and an upper face formed as a color face with a center;

rings formed, respectively, on the centers of the black and white face and the color face; and a rim formed on an outer peripheral surface of the mobile body.

2. A mobile for an infant as claimed in claim 1, wherein the mobile body is to be unfolded in a shape of a cone or an angular pyramid when the mobile is hung on a ceiling with the rings.

3. A mobile for an infant as claimed in claim 2, wherein a caught support part is further formed on the mobile and a mobile rope passes through the caught support part and a connection member is connected to both ends of the mobile rope.

4. A mobile for an infant as claimed in claim 3, further includes a decorative appliance on an upper face and a lower face of which rings are formed, respectively.

5. A mobile for an infant as claimed in claim 2, wherein a mobile rope is sewn to the mobile to form a fastening part, and the mobile rope is extended from the fastening part.

6. A mobile for an infant as claimed in claim 5, further includes a decorative appliance on an upper face and a lower face of which rings are formed, respectively.

7. A mobile for an infant as claimed in claim 2, wherein a groove is formed on the mobile and a connection member of the mobile rope is inserted into the groove, and the mobile rope passes through the mobile body to extend.

8. A mobile for an infant as claimed in claim 7, further includes a decorative appliance on an upper face and a lower face of which rings are formed, respectively.

9. A mobile for an infant as claimed in claim 2, further includes a decorative appliance on an upper face and a lower face of which rings are formed, respectively.

10. A mobile for an infant a as claimed in claim 9, wherein the upper face of the decorative appliance is formed as a black and white face and the lower face thereof is formed as a color face.

11. A mobile for an infant as claimed in claim 1, wherein a caught support part is further formed on the mobile and a mobile rope passes through the caught support part and a connection member is connected to both ends of the mobile rope.

12. A mobile for an infant as claimed in claim 11, further includes a decorative appliance on an upper face and a lower face of which rings are formed, respectively.

13. A mobile for an infant a as claimed in claim 12, wherein the upper face of the decorative appliance is formed as a black and white face and the lower face thereof is formed as a color face.

14. A mobile for an infant as claimed in claim 1, wherein a mobile rope is sewn to the mobile to form a fastening part, and the mobile rope is extended from the fastening part.

15. A mobile for an infant as claimed in claim 14, further includes a decorative appliance on an upper face and a lower face of which rings are formed, respectively.

16. A mobile for an infant a as claimed in claim 15, wherein the upper face of the decorative appliance is formed as a black and white face and the lower face thereof is formed as a color face.

17. A mobile for an infant as claimed in claim 1, wherein a groove is formed on the mobile and a connection member of the mobile rope is inserted into the groove, and the mobile rope passes through the mobile body to extend.

18. A mobile for an infant as claimed in claim 17, further includes a decorative appliance on an upper face and a lower face of which rings are formed, respectively.

19. A mobile for an infant a as claimed in claim 18, wherein the upper face of the decorative appliance is formed as a black and white face and the lower face thereof is formed as a color face.

20. A mobile for an infant as claimed in claim 1, further includes a decorative appliance on an upper face and a lower face of which rings are formed, respectively.

21. A mobile for an infant a as claimed in claim 20, wherein the upper face of the decorative appliance is formed as a black and white face and the lower face thereof is formed as a color face.

* * * * *